US006152052A

United States Patent [19]

Saxon et al.

[11] Patent Number: 6,152,052

[45] Date of Patent: Nov. 28, 2000

[54] HIGH TEMPERATURE MATERIAL FACE SEGMENTS FOR BURNER NOZZLE SECURED BY BRAZING

[75] Inventors: Daniel Isaiah Saxon; Stacey Elaine Swisher; Gary Scott Whittaker, all of Kingsport, Tenn.

[73] Assignee: Eastman Chemical Company, Kingsport, Tenn.

[21] Appl. No.: 09/332,023

[22] Filed: Jun. 14, 1999

Related U.S. Application Data

[62] Division of application No. 08/833,456, Apr. 7, 1997, Pat. No. 5,934,206.

[51] Int. Cl.[7] ..... F23D 11/00; F23D 11/36

[52] U.S. Cl. ..... 110/262; 110/104 B; 239/397.5; 431/159; 431/160

[58] Field of Search ..... 239/397.5, 288; 110/104 B, 261, 262, 347, 238; 431/181, 159, 160

[56] References Cited

U.S. PATENT DOCUMENTS

| | | | |
|---|---|---|---|
| 2,809,104 | 10/1957 | Strasser et al. . | |
| 2,840,152 | 6/1958 | Reed . | |
| 4,502,633 | 3/1985 | Saxon . | |
| 4,562,964 | 1/1986 | Diamond | 239/288.5 |
| 4,704,971 | 11/1987 | Fleischer et al. . | |
| 4,736,693 | 4/1988 | Clomburg, Jr. . | |
| 4,865,542 | 9/1989 | Hasenack et al. . | |
| 4,952,218 | 8/1990 | Lipp et al. | 48/86 R |
| 5,127,346 | 7/1992 | Kepplinger et al. . | |
| 5,129,333 | 7/1992 | Frederick et al. . | |
| 5,261,602 | 11/1993 | Brent et al. . | |
| 5,273,212 | 12/1993 | Gerhardus et al. | 239/132.3 |
| 5,513,583 | 5/1996 | Battista . | |
| 5,761,907 | 6/1998 | Pelletier et al. | 60/740 |
| 5,934,206 | 8/1999 | Saxon et al. | 110/262 |
| 5,941,459 | 8/1999 | Brooker et al. | 239/397.5 |
| 5,947,716 | 9/1999 | Bellamy et al. | 431/159 |
| 5,954,491 | 9/1999 | Helton et al. | 431/159 |

*Primary Examiner*—Stephen Gravini
*Assistant Examiner*—Ken Rinehart
*Attorney, Agent, or Firm*—Harry J. Gwinnell; Matthew W. Smith

[57] ABSTRACT

A water jacket face of a burner nozzle for a synthesis gas generator is protected from hot gas corrosion by an annular heat shield of high temperature material tiles. Angular segments of a tile annulus around a burner nozzle orifice are secured to the water jacket face by furnace melted, high temperature brazed metal. The metal water jacket face along radial joints between adjacent tiles is protected by stepped or scarfed lap joints.

54 Claims, 4 Drawing Sheets

HIGH TEMPERATURE MATERIAL FACE SEGMENTS FOR BURNER NOZZLE SECURED BY BRAZING

This application is a divisional application of U.S. Ser. No. 08/833,456, filed Apr. 7, 1997, now U.S. Pat. No. 5,934,206, issued Aug. 10, 1999.

BACKGROUND OF THE INVENTION

The present invention relates to apparatus for practicing a partial oxidation process of synthesis gas generation. In particular, the present invention is applicable to the generation of carbon monoxide, carbon dioxide, hydrogen and other gases by the partial combustion of a particulate hydrocarbon such as coal in the presence of water and oxygen.

Synthesis gas mixtures essentially comprising carbon monoxide and hydrogen are important commercially as a source of hydrogen for hydrogenation reactions and as a source of feed gas for the synthesis of hydrocarbons, oxygen-containing organic compounds or ammonia.

The partial combustion of a sulfur bearing hydrocarbon fuel such as coal with oxygen-enriched air or with relatively pure oxygen to produce carbon monoxide, carbon dioxide and hydrogen presents unique problems not encountered normally in the burner art. It is necessary, for example, to effect very rapid and complete mixing of the reactants, as well as to take special precautions to protect the burner or mixer from over heating.

Because of the reactivity of oxygen and sulfur contaminants with the metal from which a suitable burner may be fabricated, it is imperative to prevent the burner elements from reaching those temperatures at which rapid oxidation and corrosion takes place. In this respect, it is essential that the reaction between the hydrocarbon and oxygen take place entirely outside the burner proper and that localized concentration of combustible mixtures at or near the surfaces of the burner elements is prevented. Even though the reaction takes place beyond the point of discharge from the burner, the burner elements are subjected to heating by radiation from the combustion zone and by turbulent recirculation of the burning gases.

For these and other reasons, prior art burners are characterized by failures due to metal corrosion about the burner tips: even when these elements have been water cooled and where the reactants have been premixed and ejected from the burner at rates of flow in excess of the rate of flame propagation.

It is therefore an object of the present invention to provide a novel burner for synthesis gas generation which is an improvement over the shortcomings of prior art appliances, is simple in construction and economical in operation.

Another object of the invention is to provide a synthesis gas generation burner nozzle having a greater operational life expectancy over the prior art.

Another object of the present invention is to provide a gas generation burner nozzle for synthesis gas generation having a reduced rate of corrosion.

A further object of the present invention is the provision of burner nozzle heat shield to protect metallic elements of the nozzle from corrosive recirculating combustion gases.

Also an object of the present invention is a brazing method of securing heat shield tiles to a burner nozzle surface.

A still further object of the present invention is a surface protection mechanism for burner nozzles.

SUMMARY OF THE INVENTION

These and other objects of the invention as will become apparent from the detailed description of the preferred embodiment to follow are achieved by a substantially symmetric, axial flow fuel injection nozzle serving the combustion chamber of a synthesis gas generator. The nozzle is configured to have an annular slurried fuel stream that concentrically surrounds a first oxidizer gas stream along the axial core of the nozzle.

A second oxidizer gas stream surrounds the fuel stream annulus as a larger, substantially concentric annulus.

The fuel stream comprises a pumpable slurry of water mixed with finely particulated coal. The oxidizer gas contains substantial quantities of free oxygen for support of a combustion reaction with the coal.

A hot gas stream is produced in the refractory-lined combustion chamber at a temperature in the range of about 700° C. to 2500° C. and at a pressure in the range of about 1 to about 300 atmospheres and more particularly, about 10 to about 100 atmospheres. The effluent raw gas stream from the gas generator comprises hydrogen, carbon monoxide, carbon dioxide and at least one material selected from the group consisting of methane, hydrogen sulfide and nitrogen depending on the fuel and reaction conditions.

Radially surrounding a conical outer wall of the outer oxidizer gas nozzle is an annular cooling water jacket terminated with a substantially flat end-face heat sink aligned in a plane substantially perpendicular to the nozzle discharge axis.

Around the outer rim of the outer oxidizer gas annulus is a tapered thickness lip that projects to a ridge about 0.95 cm from the plane of the heat sink end-face. From the lip ridge, the heat sink structure between inside and outside surface cones diverges at approximately 15° C. The outside cone surface intersects the heat sink end-face plane at a fired transition angle of about 45° C. The internal cone surface is formed to about 30° C. with respect to the end-face plane.

Combustion reaction components comprising the fuel and oxidizer are sprayed under significant pressure of about 80 to 85 bar into the combustion chamber of the synthesis gas generator. A torroidal circulation pattern within the combustion chamber carries hot gas along an axially central course out from the nozzle face. Distally from the nozzle face, the gases begin to cool and spread radially outward toward the chamber walls. While most of the combustion product and resulting synthesis gas is drawn from the combustion chamber into a quench vessel, some of the synthesis gas recirculates against the combustion chamber walls toward the nozzle end of the chamber.

At the upper or nozzle end of the chamber, the gas circulation turns radially inward toward the nozzle discharge orifice and across the outer face plane of the nozzle end heat sink before being drawn into and along with the combustion core column.

The confluence of these two flow streams is believed to generate a standing eddy of hot, turbulent combustion product. This eddy, comprising highly corrosive sulfur compounds, surrounds the nozzle discharge orifice in the manner of a torroid and scrubs the heat shield face at the confluence. The ceramic material nature of the heat shield of the present invention resists the corrosive effects of these sulfur compounds better than the high temperature metals from which the water jacket end-face is preferably fabricated. Consequently, the operational life of the present nozzle is extended substantially beyond that of a prior art nozzle.

The heat shield of the present invention comprises a number, six for example, of ceramic tiles, each covering the end face area of a respective arc segment of an annulus around the nozzle. The tiles may be about 0.95 cm to about 1.27 cm thick except at the radial edges where each tile shingle laps with the adjacent tile.

The tiles are formed of a refractory ceramic or other high melting point material as individual elements. Tile material may, for example, be fused silicon nitride, silicon carbide zirconia, tantalum, molybdenum or tungsten. These individual tiles are secured to a high temperature base metal coolant jacket end face by a high temperature brazing compound. This assumes that the water jacket can maintain a braze joint temperature of 316° C. or less. The selected tile material should accommodate temperatures as high as 1400° C. with a high coefficient of expansion to minimize shrinkage stress which occurs as a consequence of the brazing. Additionally, the tile material should be resistant to a high temperature reducing/sulfidizing environment.

Suitable brazing compounds are Gold-ABA, Nioro-ABA and Gold-ABA-V; all proprietary products of WESCO, Inc. of Belmont, Calif.

BRIEF DESCRIPTION OF THE DRAWINGS

Further objects and characteristics of the invention will be understood from the following description of the preferred embodiments taken in connection with the drawings therein.

DESCRIPTION OF THE PREFERRED EMBODIMENTS

Figure 1:
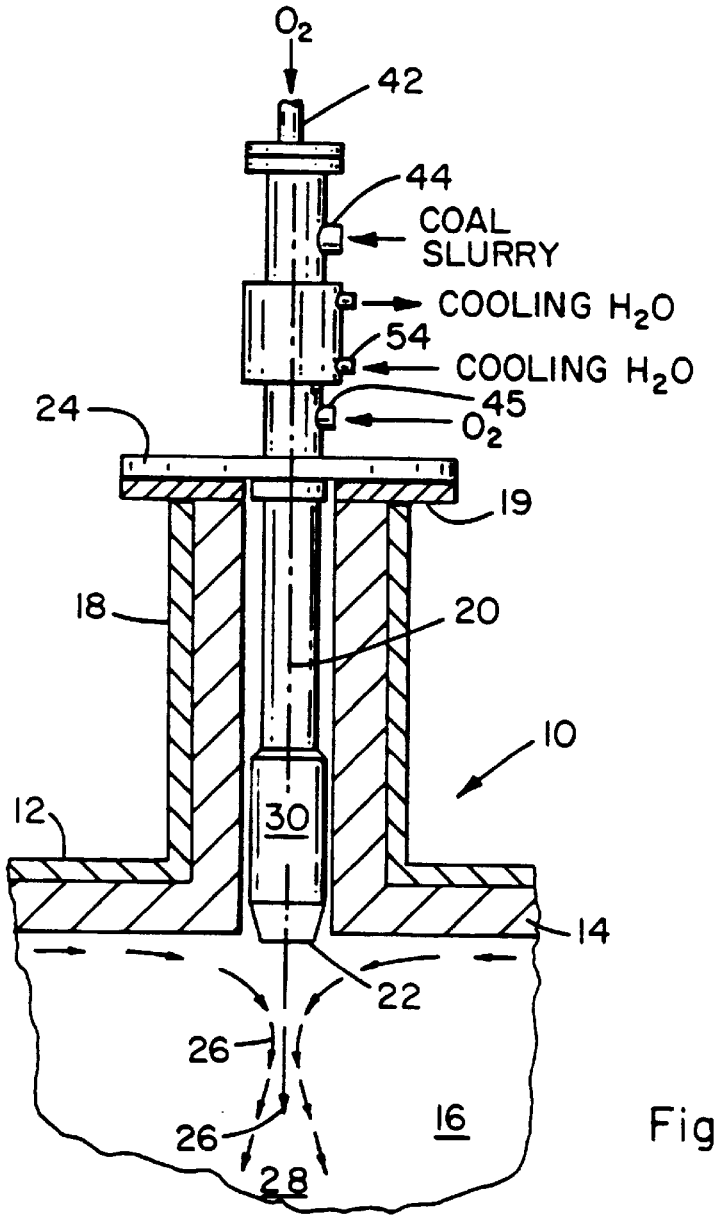
FIG. 1 is a partial sectional view of a synthesis gas generator combustion chamber and burner.

Relative to the drawings wherein like reference characters designate like or similar elements throughout the several figures of the drawing, FIG. 1 partially illustrates a synthesis gas reactor vessel 10 constructed with a structural shell 12 and an internal refractory liner 14 around an enclosed combustion chamber 16. Projecting outwardly from the shell wall is a burner mounting neck 18 for supporting an elongated fuel injection "burner" assembly 20 within the reactor vessel aligned to locate the face 22 of the burner head substantially flush with the inner surface of the refractory liner 14. A burner mounting flange 24 secured to the burner assembly 20 interfaces with a mounting neck flange 19 to secure the burner assembly 20 against the internal pressure of the combustion chamber 16.

Figure 2:
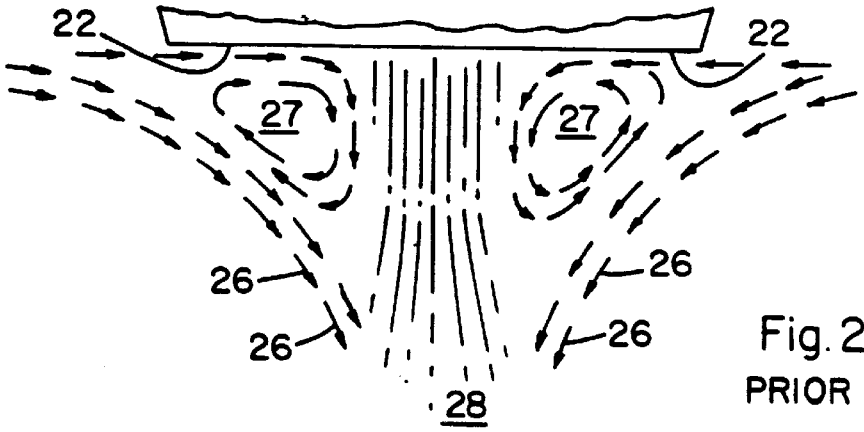
Fig. 2 PRIOR ART
FIG. 2 is a detail of the combustion chamber gas dynamics at the burner nozzle face.

Gas flow direction arrows 26 of FIGS. 1 and 2 partially represent the internal gas circulation pattern within the combustion chamber driven by the high temperature and high velocity reaction core column 28 issuing from the nozzle assembly 30. Depending on the fuel and induced reaction rate, temperatures along the reaction core may reach as high as 2500° C. As the reaction gas cools toward the end of the chamber 16 opposite from the nozzle 30, most of the gas is drawn into a quench chamber similar to that of the synthesis gas process described by U.S. Pat. No. 2,809,104 to Dale M. Strasser et al. However, a minor percentage of the gas spreads radially from the core column 28 to cool against the reaction chamber enclosure walls. The recirculation gas layer is pushed upward to the top center of the reaction chamber where it is drawn into the turbulent down flow of the combustion column 28.

With respect to the prior art model of FIG. 2, at the confluence of the recirculation gas with the high velocity core column 28, a torroidal eddy flow 27 turbulently scrubs the burner head face 22 thereby enhancing opportunities for chemical reactivity between the burner head face material and the highly reactive, corrosive compounds carried in the combustion product recirculation stream.

One of the economic advantages of a coal fed synthesis gas process is the abundance of inexpensive, high sulfur coal which is reacted within the closed combustion chamber to release both free sulfur and hydrogen sulfide. From these sources, industrially pure sulfur and sulfur bearing compounds may be formed. Within the reaction chamber 16, however, such sulfur compounds tend to react with the cobalt base metal alloy materials from which the burner head face 22 is fabricated to form cobalt sulfide at extremely high temperatures. Since the cobalt fraction of this reaction is leached from the burner structure, a self-consumptive corrosion is sustained that ultimately terminates with failure of the burner assembly 20.

Although considerably cooler combustion product gases lay within the chamber 16 as a boundary layer against the refractory walls, the gases in direct, scrubbing contact with prior art burner nozzle faces tend to be extremely hot and turbulent.

Figure 3:
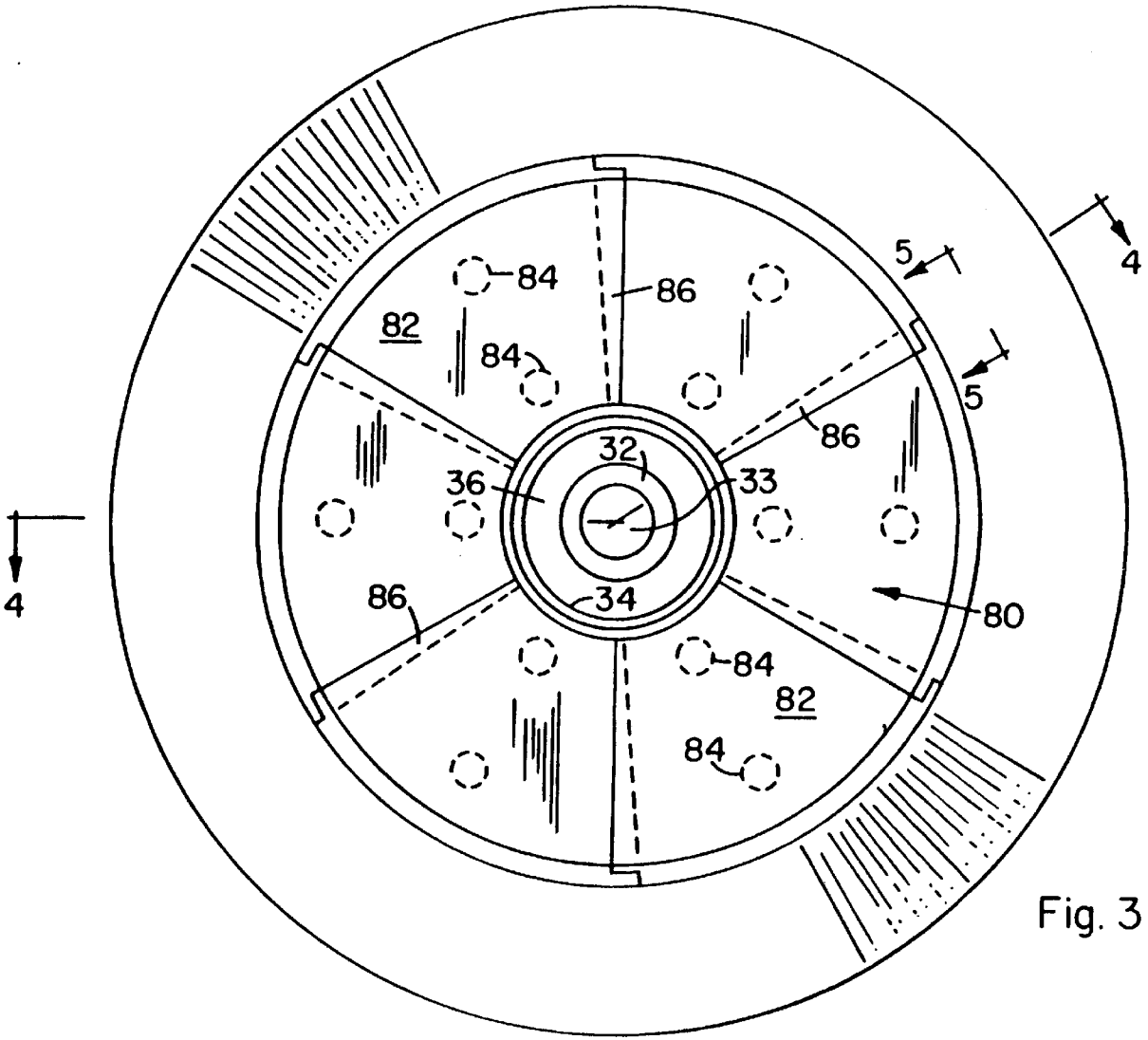
FIG. 3 is an end view of a burner nozzle discharge end.
Figure 4:
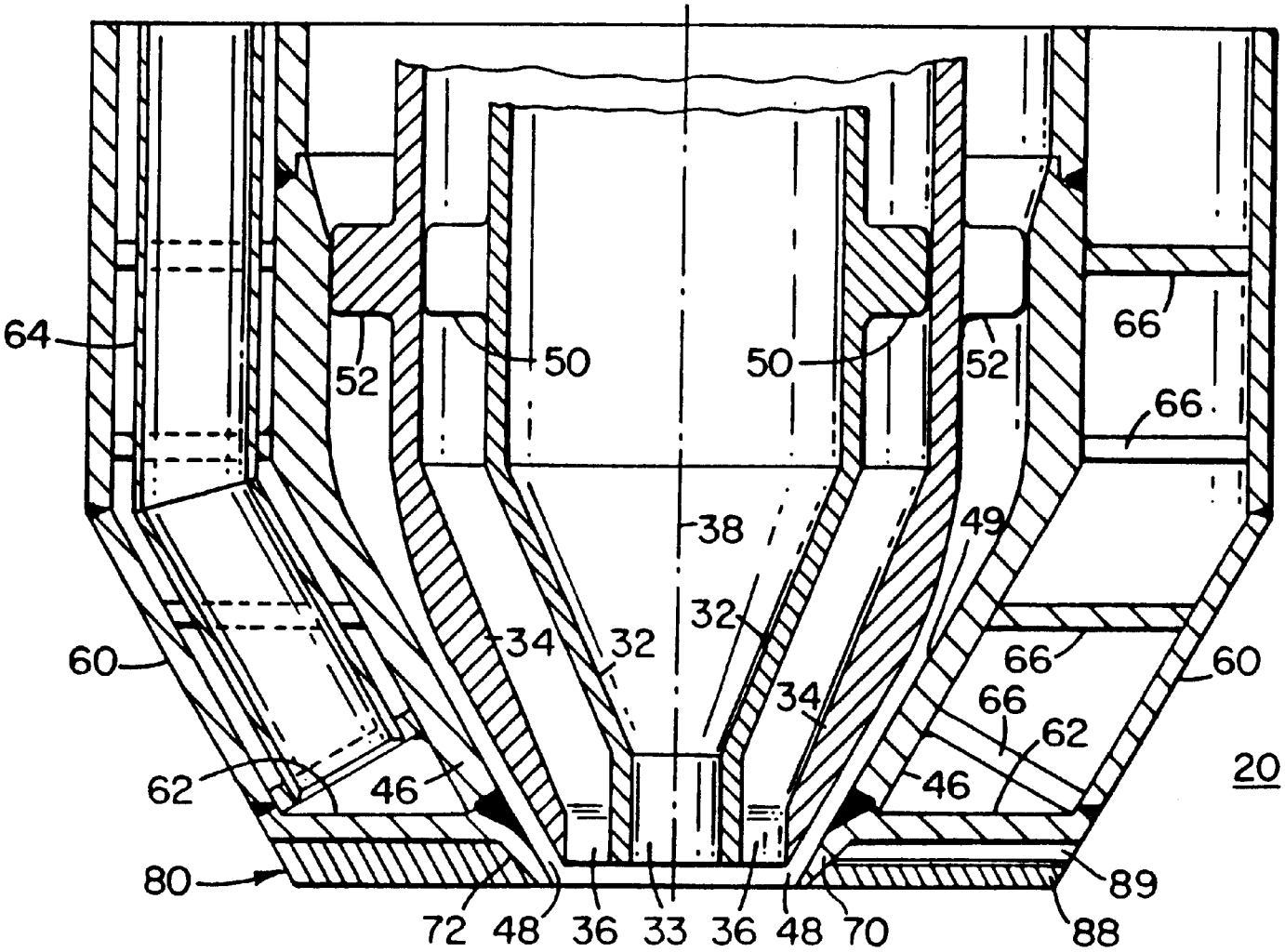
FIG. 4 is a partially sectioned elevational view of a burner nozzle as viewed along cutting planes 4—4 of FIG. 3.

With respect to FIGS. 1, 3 and 4, the burner assembly 20 of the present invention includes an injector nozzle assembly 30 comprising three concentric nozzle shells and an outer cooling water jacket. The internal nozzle shell 32 discharges from an axial bore opening 33 the oxidizer gas that is delivered along upper assembly axis conduit 42. Intermediate nozzle shell 34 guides the particulated coal slurry delivered to the upper assembly port 44. As a fluidized solid, this coal slurry is extruded from the annular space 36 between the inner shell 32 wall and the intermediate shell 34 wall. The outer, oxidizer gas nozzle shell 46 surrounds the outer nozzle discharge annulus 48 formed between the interior surface 49 of the outer shell 46 and the outer surface of the intermediate shell 34. The upper assembly port 45 supplies the outer nozzle discharge annulus with an additional stream of oxidizing gas.

Centralizing fins 50 radiating from the outer surface of the inner shell 32 wall bear against the interior wall of the intermediate shell 34 to keep the inner shell 32 coaxially centered relative to the intermediate shell axis. Similarly, centralizing fins 52 radiate from the intermediate shell 34 to coaxially confine it within the outer shell 46. It will be understood that the structure of the fins 50 and 52 form discontinuous bands about the inner and intermediate shells and offer small resistance to fluid flow within the respective annular spaces.

As described in greater detail by U.S. Pat. No. 4,502,633 to D. I. Saxon, the internal nozzle shell 32 and intermediate nozzle shell 34 are both axially adjustable relative to the outer nozzle shell 46 for the purpose of flow capacity variation. As intermediate nozzle 34 is axially displaced from the conically tapered internal surface of outer nozzle 46, the outer discharge annulus 48 is enlarged to permit a greater oxygen gas flow. Similarly, as the outer tapered surfaces of the internal nozzle 32 are axially drawn toward the internally conical surfaces of the intermediate nozzle 34, the coal slurry discharge area 36 is reduced.

Surrounding the outer nozzle shell 46 is a coolant fluid jacket 60 having a planar end-face closure 62. A coolant fluid conduit 64 delivers coolant such as water from the upper assembly supply port 54 directly to the inside surface of the end-face closure plate 62. Flow channeling baffles 66 control the coolant flow course around the outer nozzle shell, assure substantially uniform heat extraction, prevent coolant channeling and reduce localized hot spots.

Preferably, the nozzle assembly 30 components are fabricated of extremely high temperature resistant material such as an R30188 metal as defined by the Unified Numbering System for Metals and Alloys. This material is a cobalt base metal that is alloyed with chrome and tungsten. Other high temperature melting point alloys such as molybdenum, tungsten or tantalum may also be used.

As an extension of the outer nozzle shell, a nozzle lip 70 projects from the coolant jacket end-face closure 62 with a relatively narrow angle of web thickness. For example, the outer cone surface 72 of the lip may be formed to a 45° C. angle with the nozzle axis 38. If the inner cone surface 49 of the lip is given a 30° C. angle relative to the nozzle axis 38, the web angle of the lip is only 15° C.

To shield the exposed face of the closure plate 62 from the corrosively turbulent combustion gas within the chamber 16, a ceramic collar 80 is secured to the plate 62 around the nozzle lip 72. This collar 80 is assembled from six, for example, pie section tiles 82 filling the annular volume around the nozzle lip 72 and substantially parallel with the outer face of closure plate 62. Typically, the tiles may be of about 0.95 cm to about 1.27 cm thickness secured to the plate 62 by spot brazed points 84.

Suitable materials for the tiles should have a high melting point and a high coefficient of thermal expansion to minimize the shrinkage stress that occurs as a consequence of a furnace brazing procedure in the range of about 1000° C. to about 1110° C. Although the outer face of the tiles exposed directly to the combustion chamber may reach as high as 1400° C., due to the fluid cooling jacket 60 the braze joint interface should remain below 600° C. Additional characteristics required of the ceramic are a high fracture toughness to accommodate the shrinkage stress and resistance to a high temperature, reducing/sulfidizing environment. Meeting these characteristics are silicon nitride, silicon carbide and zirconia based ceramics such as Zirconia TZP and Zirconia ZDY which are the proprietary products of the Coors Corp. of Golden, Colo.

Brazing materials capable of direct bonding of the ceramic tiles to an R30188 cobalt base coolant jacket base metal may include the gold and silver alloys of nickel. For example, the Nicro-ABA alloy of WESCO, Belmont, Calif., has a brazing temperature of about 1000° C. to about 1050° C. and a tensile strength of about $60.7\times10^4$ Pa. The nominal composition of Nicro-ABA is about 15.5% Ni, 0.75% Mo, 1.75%V and the balance of Au.

Another candidate alloy of WESCO is Gold-ABA-V having a nominal composition of 1.75%V, 0.75%Ni and the balance Au. This material has a brazing temperature of about 1090° C. to about 1110° C. Tensile strength is about $29.437\times10^4$ Pa.

A useful silver base alloy of WESCO is Silver-ABA which nominally comprises 5% Cu, 1.25%Ti, 1.0% Al and the balance Ag. The tensile strength is about $28.1964\times10^4$ Pa.

Figure 5:
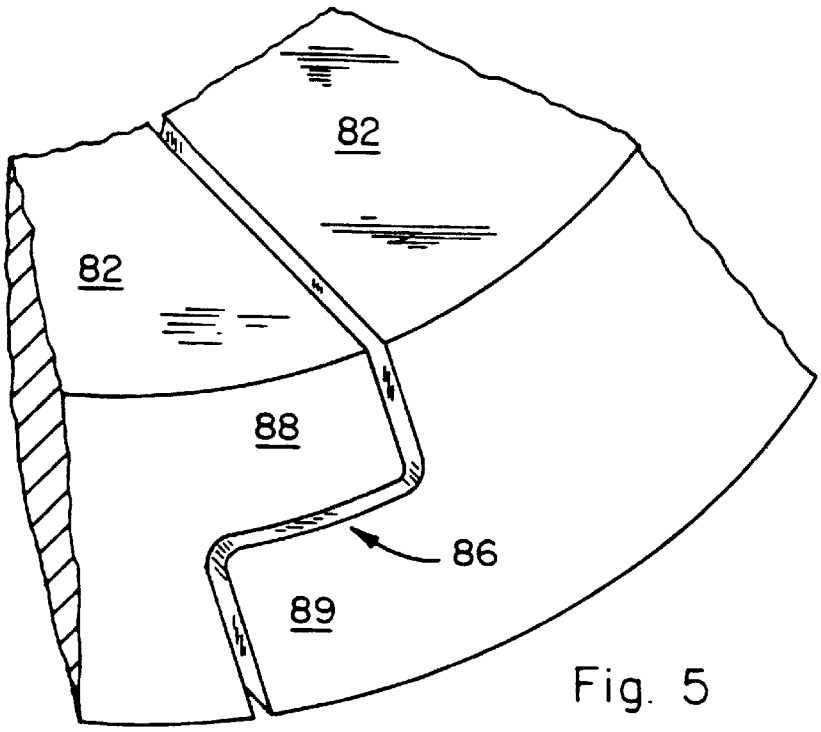
FIG. 5 is a detail of a stepped lap joint embodiment of the invention.
Figure 6:
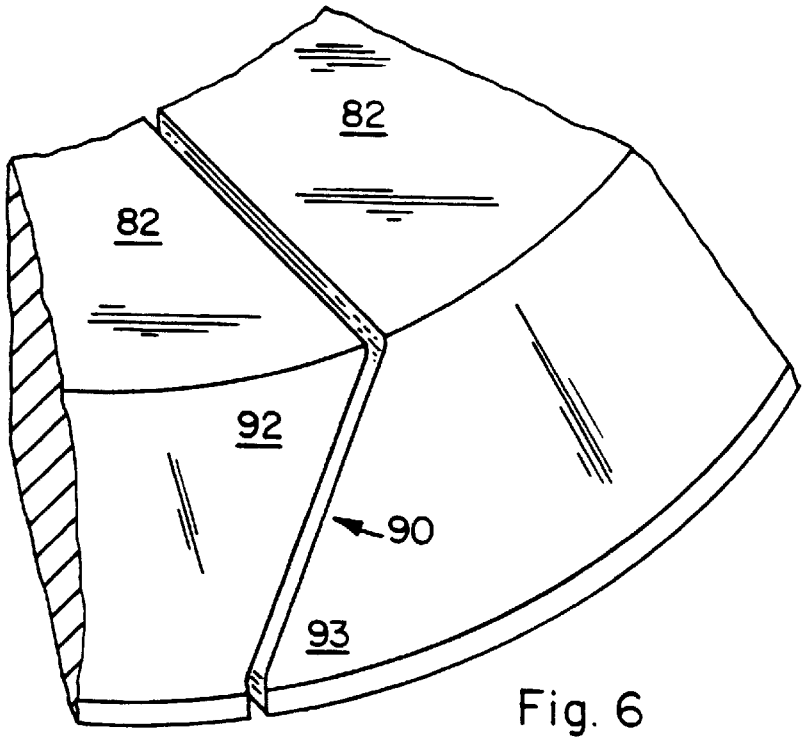
FIG. 6 is a detail of a scarfed lap joint embodiment of the invention.

Segmenting the collar 80 into a plurality of independently bonded, smaller tile units 82 is a mechanical device for reducing the internal thermal stress by isolating stress differentials. Each tile may thermally creep or "breath" independently of an adjacent tile. However, to protect the metal cooling jacket walls from direct gas scrubbing through open tile joints, the present invention provides lap joints between the tiles as shown by FIGS. 3, 5 and 6. With respect to FIGS. 3 and 5, the lap joints 86 are stepped with a substantially square shingling between an overlaid tongue 88 and an underlaid tongue 89.

FIG. 6 illustrates a scarfed joint 90 having a tapered interface between the upper lap 92 and the lower lap 93.

Having described our invention in detail with particular reference to the preferred embodiment, it will be understood that variations and modifications can be implemented within the scope of the invention disclosed.

We claim:

1. A synthesis gas reaction chamber penetrated by a burner nozzle end-face comprising said end-face circumferentially surrounding a reaction material discharge aperture and having a high temperature material heat-shield secured thereto, wherein the shield includes a plurality of independent tiles, and wherein at least one of the tiles overlaps at least one other of the tiles.

2. A synthesis gas reaction chamber as described by claim 1, wherein said heat shield is secured to said end-face by a fused metal alloy.

3. A synthesis gas reaction chamber as described by claim 2, wherein each tile is a circular arc segment secured to said end-face about said material discharge aperture.

4. A synthesis gas reaction chamber as described by claim 3, wherein said arc segments are aligned with contiguous radial edge joints.

5. A synthesis gas reaction chamber as described by claim 4, wherein said contiguous radial edge joints are one of step and scarf lapped.

6. A synthesis gas reaction chamber as described by claim 5, wherein each arc segment is independently secured to said face by brazing.

7. A synthesis gas reaction chamber as described in claim 1, wherein a portion of one of the tiles overlaps a portion of another of the tiles.

8. A synthesis gas reaction chamber as described in claim 1, wherein the high temperature material is ceramic.

9. A synthesis gas reaction chamber as described by claim 8, wherein the ceramic is selected from the group comprising silicon nitride, silicon carbide and zirconium based ceramics.

10. A synthesis gas reaction chamber as described by claim 2, wherein the metal alloy is selected from the group comprising gold and silver alloys of nickel.

11. A synthesis gas reaction chamber penetrated by a burner nozzle end-face comprising said end-face circumferentially surrounding a reaction material discharge aperture and having a heat-shield secured thereto, wherein the shield includes a plurality of overlapping independent ceramic tiles.

12. A synthesis gas reaction chamber as described by claim 11, wherein said heat shield is secured to said end-face by a fused metal alloy.

13. A synthesis gas reaction chamber as described by claim 11, wherein each tile is a circular arc segment secured to said end-face about said material discharge aperture.

14. A synthesis gas reaction chamber as described by claim 13, wherein said arc segments are aligned with contiguous radial edge joints.

15. A synthesis gas reaction chamber as described by claim 14, wherein said contiguous radial edge joints are one of step and scarf lapped.

16. A synthesis gas reaction chamber as described by claim 15, wherein each arc segment is independently secured to said face by brazing.

17. A synthesis gas reaction chamber as described by claim 11, wherein the ceramic is selected from the group comprising silicon nitride, silicon carbide and zirconium based ceramics.

18. A synthesis gas reaction chamber as described by claim 12, wherein the metal alloy is selected from the group comprising gold and silver alloys of nickel.

19. A synthesis gas reaction chamber penetrated by a burner nozzle end-face comprising said end-face circumferentially surrounding a reaction material discharge aperture and having a high temperature material heat-shield secured thereto, wherein said heat-shield is secured to said end-face by a fused metal alloy, wherein said heat-shield comprises a plurality of circular arc segments secured to said end-face about said material discharge aperture, and wherein at least one of the plurality of circular arc segments overlaps at least one other of the plurality of circular arc segments.

20. A synthesis gas reaction chamber as described by claim 19, wherein said plurality of arc segments is aligned with contiguous radial edge joints.

21. A synthesis gas reaction chamber as described by claim 20, wherein said contiguous radial edge joints are step lapped.

22. A synthesis gas reaction chamber as described by claim 21, wherein each arc segment of said plurality is independently secured to said face by brazing.

23. A synthesis gas reaction chamber penetrated by a burner nozzle end-face comprising said end-face circumferentially surrounding a reaction material discharge aperture and having a high temperature material heat-shield secured thereto, wherein the shield includes a plurality of independent tiles, wherein said heat-shield is secured to said end-face by a fused metal alloy, wherein each tile is a circular arc segment secured to said end-face about said material discharge aperture, wherein said arc segments are aligned with contiguous radial edge joints, and wherein said contiguous radial edge joints are one of step and scarf lapped.

24. A synthesis gas reaction chamber as described by claim 23, wherein each arc segment is independently secured to said face by brazing.

25. A synthesis gas reaction chamber as described in claim 23, wherein a portion of one of the tiles overlaps a portion of another of the tiles.

26. A synthesis gas reaction chamber as described in claim 23, wherein the high temperature material is ceramic.

27. A synthesis gas reaction chamber as described by claim 26, wherein the ceramic is selected from the group comprising silicon nitride, silicon carbide and zirconium based ceramics.

28. A synthesis gas reaction chamber penetrated by a burner nozzle end-face comprising said end-face circumferentially surrounding a reaction material discharge aperture and having a high temperature material heat-shield secured thereto, wherein the shield includes a plurality of independent tiles, wherein said heat shield is secured to said end-face by a fused metal alloy, and wherein the metal alloy is selected from the group comprising gold and silver alloys of nickel.

29. A synthesis gas reaction chamber as described by claim 28, wherein each tile is a circular arc segment secured to said end-face about said material discharge aperture.

30. A synthesis gas reaction chamber as described by claim 29, wherein said arc segments are aligned with contiguous radial edge joints.

31. A synthesis gas reaction chamber as described by claim 30, wherein said contiguous radial edge joints are one of step and scarf lapped.

32. A synthesis gas reaction chamber as described by claim 31, wherein each arc segment is independently secured to said face by brazing.

33. A synthesis gas reaction chamber as described in claim 28, wherein a portion of one of the tiles overlaps a portion of another of the tiles.

34. A synthesis gas reaction chamber as described in claim 28, wherein the high temperature material is ceramic.

35. A synthesis gas reaction chamber as described by claim 34, wherein the ceramic is selected from the group comprising silicon nitride, silicon carbide and zirconium based ceramics.

36. A synthesis gas reaction chamber penetrated by a burner nozzle end-face comprising said end-face circumferentially surrounding a reaction material discharge aperture and having a high temperature material heat-shield secured thereto, wherein said heat-shield is secured to said end-face by a fused metal alloy, wherein said heat-shield comprises a plurality of circular arc segments secured to said end-face about said material discharge aperture, wherein said plurality of arc segments is aligned with contiguous radial edge joints, and wherein said contiguous radial edge joints are step lapped.

37. A synthesis gas reaction chamber as described by claim 36, wherein each arc segment of said plurality is independently secured to said face by brazing.

38. A synthesis gas reaction chamber as described by claim 36, wherein said contiguous radial edge joints are scarf lapped.

39. A synthesis gas reaction chamber as described in claim 36, wherein a portion of one of the arc segments overlaps a portion of another of the arc segments.

40. A synthesis gas reaction chamber as described in claim 36, wherein the high temperature material is ceramic.

41. A synthesis gas reaction chamber as described by claim 40, wherein the ceramic is selected from the group comprising silicon nitride, silicon carbide and zirconium based ceramics.

42. A synthesis gas reaction chamber as described by claim 36, wherein the metal alloy is selected from the group comprising gold and silver alloys of nickel.

43. A synthesis gas reaction chamber penetrated by a burner nozzle end-face comprising said end-face circumferentially surrounding a reaction material discharge aperture and having a high temperature material heat-shield secured thereto, wherein the shield includes a plurality of independent planar tiles.

44. A synthesis gas reaction chamber as described by claim 43, wherein said heat-shield is secured to said end-face by a fused metal alloy.

45. A synthesis gas reaction chamber as described by claim 44, wherein each tile is a circular arc segment secured to said end-face about said material discharge aperture.

46. A synthesis gas reaction chamber as described by claim 45, wherein said arc segments are aligned with contiguous radial edge joints.

47. A synthesis gas reaction chamber as described in claim 43, wherein the high temperature material is ceramic.

48. A synthesis gas reaction chamber as described by claim 47, wherein the ceramic is selected from the group comprising silicon nitride, silicon carbide and zirconium based ceramics.

49. A synthesis gas reaction chamber as described in claim 43, wherein at least one of the plurality of tiles overlaps at lease one other of the plurality of tiles.

50. A synthesis gas reaction chamber as recited in claim 43, wherein the plurality of tiles forms only a single ring on the end face.

51. A synthesis gas reaction chamber penetrated by a burner nozzle end-face comprising said end-face circumferentially surrounding a reaction material discharge aperture and having a high temperature material heat-shield secured thereto, wherein said heat-shield is secured to said end-face by a fused metal alloy, and wherein said heat-shield comprises a plurality of planar circular arc segments secured to said end-face about said material discharge aperture.

52. A synthesis gas reaction chamber as described by claim 49, wherein said plurality of arc segments is aligned with contiguous radial edge joints.

53. A synthesis gas reaction chamber as described in claim 51, wherein at least one of the plurality of tiles overlaps at least one other of the plurality of tiles.

54. A synthesis gas reaction chamber as described in claim 53, wherein the plurality of tiles forms only a single ring on the end face.

* * * * *